US010124476B2

(12) United States Patent
Owen

(10) Patent No.: US 10,124,476 B2
(45) Date of Patent: Nov. 13, 2018

(54) AUTOMATICALLY REPOSITIONING STAPLER

(71) Applicant: Tanner Burleson Owen, North Hollywood, CA (US)

(72) Inventor: Tanner Burleson Owen, North Hollywood, CA (US)

( * ) Notice: Subject to any disclaimer, the term of this patent is extended or adjusted under 35 U.S.C. 154(b) by 595 days.

(21) Appl. No.: 14/740,104

(22) Filed: Jun. 15, 2015

(65) Prior Publication Data

US 2016/0361808 A1 Dec. 15, 2016

(51) Int. Cl.
*B25C 5/02* (2006.01)

(52) U.S. Cl.
CPC ..... *B25C 5/0242* (2013.01)

(58) Field of Classification Search
CPC ..... B25C 5/0242; B25C 5/0228; B25C 5/15; B27F 7/006; B27F 7/17
USPC ..... 227/107, 100, 111, 110, 148, 155
See application file for complete search history.

(56) References Cited

U.S. PATENT DOCUMENTS 4,113,164 A * 9/1978 Muthenthaller ..... B25C 5/0292 227/124
4,199,095 A * 4/1980 Yamanoi ..... B25C 5/1679 227/120
5,639,078 A * 6/1997 Mandel ..... B42C 1/12 270/58.12
H1842 H * 3/2000 Tontarski ..... B25C 5/00 227/100
7,857,182 B2 * 12/2010 Kato ..... B25C 5/0228 227/131
2004/0216240 A1 * 11/2004 Kramer ..... B25C 5/025 7/158
2009/0261141 A1 * 10/2009 Stratton ..... B25C 5/00 227/131

* cited by examiner

*Primary Examiner* — Andrew M Tecco
*Assistant Examiner* — Nicholas Igbokwe
(74) *Attorney, Agent, or Firm* — Omni Legal Group; Omid E. Khalifeh

(57) ABSTRACT

A device for automatically offsetting pronged fasteners, or staples, in successively fastened sets of sheet material is provided. The assembly may be disposed within any manual or power driven stapler. It may comprise a manually or electrically rotatable drive gear which, when rotated, pushes a means for setting the depth at which such fasteners may be delivered into such sheet material respective to an edge thereof. In use, stacked sheets of material, such as paper, may be placed within a stapler. Then, when the stapler is activated to fasten the set, the drive gear may automatically rotate to push the means for setting the depth forward so that a subsequently delivered fastener may be delivered into a following set of sheet material at a different depth from the edge of the prior set.

13 Claims, 6 Drawing Sheets

AUTOMATICALLY REPOSITIONING STAPLER

GOVERNMENT CONTRACT

Not applicable.

CROSS-REFERENCE TO RELATED APPLICATIONS

Not applicable.

STATEMENT RE. FEDERALLY SPONSORED RESEARCH/DEVELOPMENT

Not applicable.

COPYRIGHT & TRADEMARK NOTICES

A portion of the disclosure of this patent document may contain material that is subject to copyright protection. This patent document may show and/or describe matter that is or may become trade dress of the owner. The copyright and trade dress owner has no objection to the facsimile reproduction by any one of the patent document or the patent disclosure, as it appears in the Patent and Trademark Office patent files or records, but otherwise reserves all copyrights and trade dress rights whatsoever.

TECHNICAL FIELD

The disclosed subject matter relates generally to staplers for securing sheets together and, more particularly, to staplers that decrease space occupied by stacks of stapled papers.

BACKGROUND

Staplers that press wire fasteners into stacks of sheet materials are typical means for securely joining packets of paper in schools, offices, and the home alike. When using a traditional stapler to fasten sheets together, fasteners are inserted at a pre-determined offset with respect to the sheets themselves. For example, the fastener might be placed half of an inch from the edge of a sheet. The result of a fixed offset is that, when stacking multiple packets or sets of fastened sheets, the fasteners of each set abut each other. This increases the amount of storage space required for sets of fastened sheets because the thickness of the abutted fasteners results in dramatically increased stack thickness and bulge in and around the location where such fasteners are in contact. This causes the sets to occupy greater volume than accounted for by the paper itself and further makes stacking, transporting, storing, and delivering the packets inefficient and unwieldy.

Attempts have been made to address this problem. For example, U.S. Pat. No. 5,639,078 to Mandel et al. discloses a system in which printed and collated sheets are automatically repositioned with respect to each other so that staples in printed packets do not cause any bulges created by stacked staples to interfere with outcoming packets. This solution is deficient because, once stacked to be placed in a binder or box or other container, the staples still abut, interfering with one another to create a space-inefficient bulge. U.S. Pat. No. 6,402,006 to Nunes et al. discloses a stapler selectively transitionable between a first and a second mode to allow a user to alternatively staple sheets at an angle to or parallel with an edge of the sheets. This solution is deficient because a user of the stapler must perform such a transition manually. Moreover, once a mode is selected, each successive staple is placed at a predetermined offset as discussed above, effecting the same space-inefficient bulge.

Other solutions have attempted to solve the problems by causing the staple itself to flatten against any secured sheets more than previously achieved. For example, U.S. Patent App. No. 2011/0062210 filed by Leung teaches an anvil adapted to fold over legs of the staple flat only once the legs have been driven straight through the sheet materials. U.S. Patent App. No. 2014/0203060 filed by Marks teaches a slotted anvil having restoratively biased arms that push any staple legs flat to secure packets together. Still, these solutions are deficient because, in the aggregate, volume added by even flat staples abutting one another still causes space-inefficiencies.

Although various proposals have been made to solve the problem, none of those in existence combine the characteristics of the present invention. Therefore, there is a need for a stapler that decreases the volume of stacked papers via an automatically repositioning assembly.

SUMMARY

The present disclosure is directed to staplers for fastening sheet material together. More particularly, in part, a stapler is provided that comprises a repositioning assembly that automatically adjusts by a preset incremental amount each time the stapler is activated to fasten sheet material together. It is to be understood that a repositioning assembly may comprise a plurality of different means for setting the depth at which fasteners can be delivered into the sheet material relative to an edge of the sheet material. These include, but are not limited to, paper stops or plunger and anvil assemblies along with all equivalents such as those found in as electric desktop staplers or staplers disposed within copy machines.

As the repositioning assembly incrementally adjusts, then, the depth at which a plurality of sheet material, such as paper, may be placed into the stapler is changed. In this manner, fasteners are delivered into different regions of successively fastened sheets so that when the sheets are stacked, the fasteners do not lie directly on top of one another. Instead, the fasteners are offset, decreasing the thickness added to a stack, or set, of fastened sheets that is typically caused when numerous fasteners abut each other.

For purposes of summarizing, certain aspects, advantages, and novel features have been described. It is to be understood that not all such advantages may be achieved in accordance with any one particular embodiment. Thus, the disclosed subject matter may be embodied or carried out in a manner that achieves or optimizes one advantage or group of advantages without achieving all advantages as may be taught or suggested.

In an embodiment, a repositioning assembly may be disposed within any stapler known in the art for use in the home, office, schools, and the like. Such staplers may have, for example, a body having a cartridge for dispensing fasteners such as staples, a cap for covering the cartridge, means for delivering the staples through the cartridge—such as a plunger disposed on an underside of the cap—and a base on which an anvil for bending staple legs around a backside of any fastened sheets. The base may moreover have a front end and a rear end, the base further having an anvil disposed on the front end of the base, wherein the cartridge is pivotally connected to the base and is further resiliently biased toward a resting upper position.

The repositioning assembly may itself comprise a foot for supporting the assembly. In an embodiment, the foot may be disposed on the rear end of the base, beneath the stapler cartridge. Additionally, a means for setting the depth at which fasteners can be delivered into the sheet material relative to an edge of the material is provided. Such means may have a rear portion that is slideably mateable with the foot, a front stopper portion formed as a barrier to define the depth that any sheets may be inserted into the stapler, and a middle portion for rigidly spacing the front and rear portions.

In one embodiment, the repositioning assembly may be anchored to the stapler and may further be resiliently biased in the direction of the rear portion. Thus, for example, a spring may connect the rear portion of the means for setting the depth to a portion of the stapler. In one embodiment, a spring may connect the rear portion of the sheet stop directly to the base of the stapler. In another embodiment, an anchor that is permanently or removably disposed on the base or cartridge of the stapler may be provided, and a spring may connect the rear portion of the sheet stop directly to such an anchor.

In other embodiments, the means for setting the depth may be a plunger provided to press fasteners into a set of sheets of material. In such a case, the repositioning assembly may be placed along an underside of a cap of the stapler, and any sheet stop provided may be stationary.

The repositioning assembly may further comprise means for incrementally adjusting the position of the means for setting the depth at which at which fasteners can be delivered into the sheet material. In one embodiment the means may include, in part, a rotating drive gear, which automatically rotates in response to activation of the stapler. In one embodiment, a bottommost tooth in the gear drive may be in physical contact with the rear portion of the means for setting the depth, pressing opposite its resilient bias. Then, each time the stapler is used to fasten a set of sheets, the drive gear may be rotated to adjust the position of the means for setting the depth.

Of course, one skilled in the art will recognize that a stapler may be either manually or electrically activated to deliver fasteners into a set of sheets. Additionally, incrementally adjusting the means for setting the depth may be mechanical or electrical. Thus neither activation nor adjusting should be limited in any respect. Indeed, in some embodiments, the gear drive may be axially and rotationally coupled to a motor having a switch that triggers the motor each time the stapler is activated.

In another embodiment, rotation of the gear drive may occur mechanically. For example, one or more additional repositioning gears may be provided to flank the drive gear. In such an embodiment, the one or more repositioning gears may be in contact with the rear portion of the means for setting the depth at which fasteners can be delivered into the sheet material. Still it is contemplated that the drive gear and one or more repositioning gears may rotate together by the same incremental amount each time the stapler is activated. Because the front portion of the means for setting the depth defines the depth at which any sheets fasteners can be delivered into sheet material relative to an edge of the sheet material, adjusting the repositioning assembly each time the stapler is activated may ensure that successively delivered fasteners are offset from one another.

Thus, in one embodiment, the repositioning assembly may be disposable within a stapler, and the front stopper portion of the means for setting the depth may define a barrier that limits the depth at which sheet material can be inserted into the stapler which may be automatically, incrementally adjusted. Each incremental adjustment automatically made to the means for setting the depth may then cause successively delivered fasteners to be offset from one another. It is contemplated that this may avoid causing any fasteners provided on stacked sets of sheets to abut, undesirably creating space inefficient bulging on and around the area occupied by abutting fasteners.

Configured according to any of the aforementioned embodiments, sheets of material may be placed between the cartridge and anvil of the stapler until an edge of the stack rests flush against the front stopper portion of the exemplary means for setting the depth. Then the stapler may be activated to deliver a fastener, such as a staple, through the sheets by pressing the cartridge toward the anvil. In some embodiments, activation may be manual. For example, a manual office stapler may be activated when a user presses down on the cap. In other embodiments, activation may be automatic. For example, power driven staplers, such as electric desktop staplers or even those staplers disposed within copy machines to staple collated photocopies, are known to be automatically activated.

Upon activating the stapler to press the cartridge toward the anvil, rotation of the drive gear may begin. In an embodiment, this rotation will automatically effect repositioning of the assembly, which in turn will automatically offset any staples placed in successive packets of sheet material from one another.

One embodiment of the present invention may further comprise a gear pin. Such a gear pin may be positioned so as to prevent counter rotation of the drive gear. In this embodiment, the gear pin may be operable to prevent undesirable interference with rotation of the gears while the stapler is in use.

As the stapler is released toward its resting, upward position, the drive gear may turn and move the means for setting the depth component repositioning assembly forward by a predetermined increment. This increment may be set, for example, by the distance between each tooth in the drive gear. Once it has moved a certain number of increments, the resilient bias of the means for setting the depth may cause the means for setting the depth to retract toward the rear end of the stapler to a first starting position. For example, in some embodiments, the gear drive, and thus repositioning assembly, may be configured to have five positions, each at ⅛ inch increments. If the start position causes the barrier of the means to set a depth of ½ inch (or ⅝ inch) from an edge of the sheets provided, then the following would happen if the stapler was used to fasten six sets of sheets: A fastener would be delivered into successive sets of sheets at ⅝, ⅝, ⅝, ⅞, 8/8 inches, and then repeating such successively spaced fastening at ⅝ inches from an edge of the sheets. Of course, one skilled in the art will recognize that the particular number of positions achieved, as well as the size of each increment, may be selected or adjusted. The foregoing is simply provided by way of example and of illustration and is not meant to limit the invention.

Thus, it is an object of the invention to provide a device for decreasing volume occupied by stacked packets of fastened sheet material.

It is a further object of the invention to provide a device that automatically offsets fasteners delivered into successive packets or sets of sheet material from one another.

It is another object of the invention to provide an automatically repositioning assembly in a manual or power driven stapler.

It is yet another object of the invention to provide a device to retrofit manual and power driven staplers available in the marketplace so that they may become automatically repositioning staplers.

One or more of the above-disclosed embodiments, in addition to certain alternatives, are provided in further detail below with reference to the attached figures. The disclosed subject matter is not, however, limited to any particular embodiment disclosed.

Figure 1:
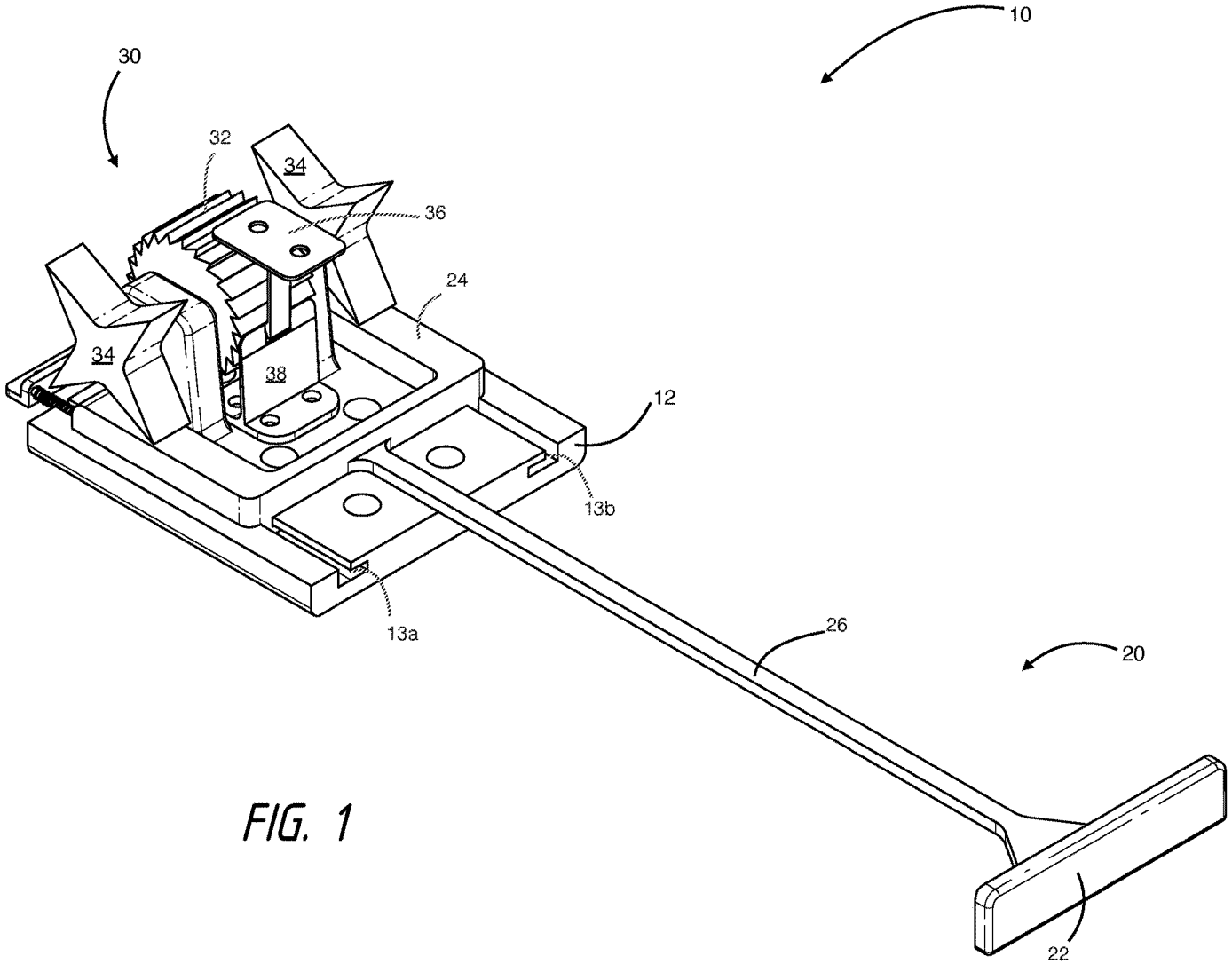
FIG. 1 is a perspective view of an embodiment of a gear and repositioning assembly effecting automatic repositioning of a stapler.

The disclosed embodiments may be better understood by referring to the figures in the attached drawings, as provided below. The attached figures are provided as non-limiting examples for providing an enabling description of the apparatus claimed. Attention is called to the fact, however, that the appended drawings illustrate only typical embodiments of this invention and are therefore not to be considered as limiting of its scope. One skilled in the art will understand that the invention may be practiced without some of the details included in order to provide a thorough enabling description of such embodiments. Well-known structures and functions have not been shown or described in detail to avoid unnecessarily obscuring the description of the embodiments.

DETAILED DESCRIPTION

Having summarized various aspects of the present disclosure, reference will now be made in detail to that which is illustrated in the drawings. While the disclosure will be described in connection with these drawings, there is no intent to limit it to the embodiment or embodiments disclosed herein. Rather, the intent is to cover all alternatives, modifications and equivalents included within the spirit and scope of the disclosure as defined by the appended claims.

With reference to FIG. 1 an embodiment of the repositioning assembly 10 may comprise a foot 12, or base, means for setting the depth at which fasteners can be delivered into sheet material, and a gear assembly 30. Here, the means for setting the depth is illustrated as a sheet stop 20, however, one skilled in the art will recognize that alternative means may be substituted without departing from the invention. Indeed, such means may include, but are not limited to, other types of sheet or paper stops, plunger and anvil assemblies, and any other equivalents such as those found in electric desktop staplers or staplers disposed within copy machines. As such, the sheet stop 20, is only one example of a means for setting the depth at which fasteners can be delivered into the sheet material, and has been provided only for the sake of illustrating, rather than limiting, an embodiment of such means.

The sheet stop 20 may have a front portion 22 formed as a stopper having vertical thickness to block a set of sheet material, such as paper, to be fastened together. A rear portion 24 of the sheet stop 20 is further provided to slideably mate with the foot 12. In an embodiment, the rear portion 24 may be formed as forked prongs which surround the gear assembly 30. Of course, one skilled in the art will recognize that such a forked configuration is not necessary to practice the invention but provided instead illustrate a possible embodiment. Indeed, the rear portion 24 may be formed as a unified piece or even comprise additional forked members. Moreover, the method of slideably mating the rear portion 24 with the foot 12 may vary. In one embodiment, for example, the foot 12 may be formed to define a first and second track 13*a*, 13*b* for receiving flanges formed on the bottom of the rear portion.

Next, a middle portion 26 of the sheet stop 20 may be provided to permanently and rigidly space the front and rear portions 22, 24, and ensure alignment of the sheet stop in motion.

Means for incrementally adjusting the position of the sheet stop may be provided as the gear assembly 30 configured to automatically rotate in response to activation of the stapler. In one embodiment the means may include a drive gear 32, one or more repositioning gears 34, a gear pin 36, and a gear lock 38. Although the drive gear 32 and repositioning gears 34 are illustrated as separate elements, it is contemplated that a single rotatable gear may be provided instead.

Figure 2:
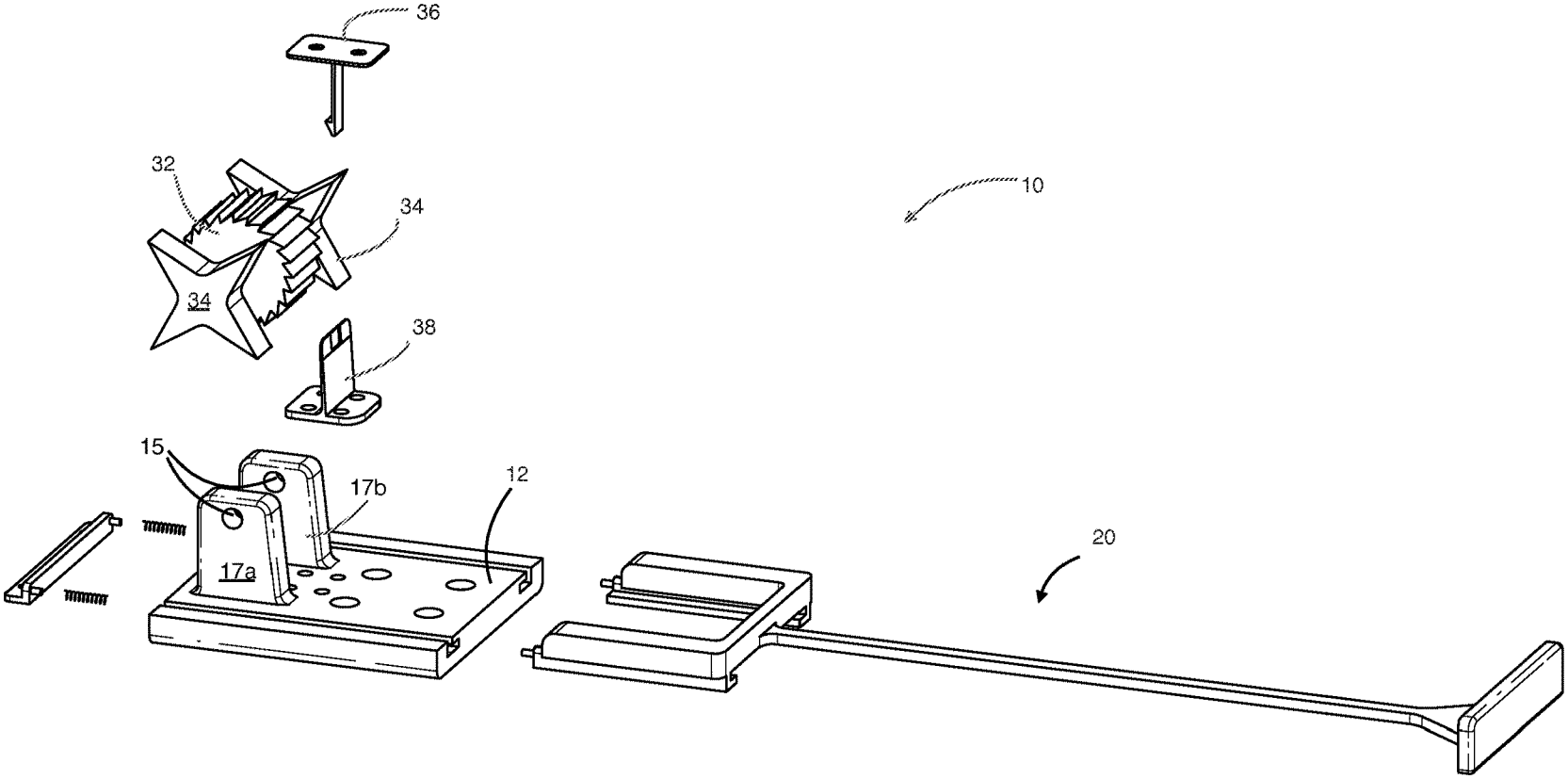
FIG. 2 shows an exploded view of the assembly illustrated in FIG. 1.

Referring now to FIG. 2 an exploded view of an embodiment of the repositioning assembly 10 is provided to more clearly illustrate the separate parts that may comprise the assembly. For example, it may be seen that the drive gear 32 and repositioning gears 34 may be axially aligned with each other and further secured above the foot 12 through holes 15 tabs 17*a* and 17*b* extending upward from the foot 12. Of course, the foregoing is offered by way of example only. One skilled in the art will recognize that various means for and methods of securing the drive gear 32 and repositioning gears 34 above the foot 12 so that they may rotate together may be available.

The repositioning assembly may further comprise means for rotating the gears. In one embodiment, means for rotating the gears may be a gear pin 36 configured to successively mesh with each tooth in the drive gear 32. As may be seen with reference to later figures, which will be more fully described below, rotation may occur when the gear pin 36 is moved to mesh with a lower tooth in the drive gear 32. When the gear pin 36 returns to its original upward position, it pulls the drive gear 32 by the lower tooth so that it may rotate by a distance defined by the space between teeth.

Figure 3:
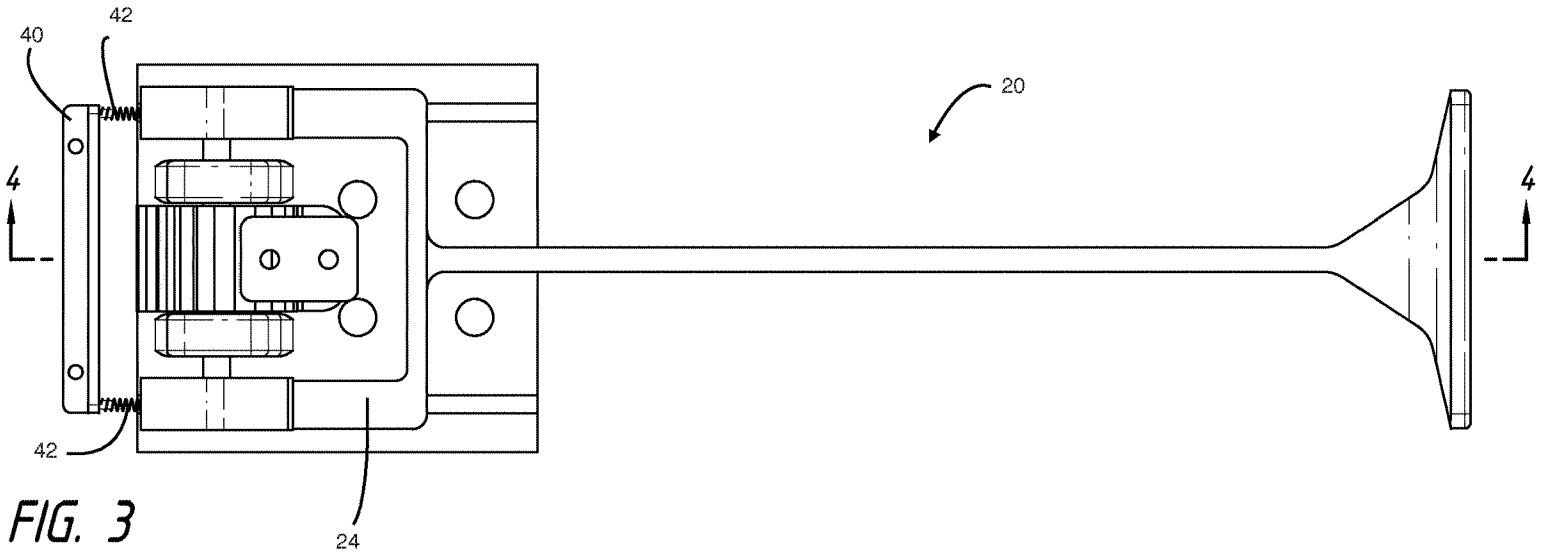
FIG. 3 is an aerial view of the assembly illustrated in FIG. 1.

Referring now to FIG. 3, an overhead view taken along line 4 illustrates that in one embodiment, the sheet stop 20 may further comprise an anchor 40 for securing the sheet stop 20, or other means for setting the depth at which a fastener can be delivered into a sheet, to the stapler in which it is disposed. The exemplary sheet stop 20 may further be resiliently biased in the direction of the rear portion 24 of the sheet stop 20, toward the anchor 40. Thus, for example, one or more springs 42 may connect the rear portion 24 of the sheet stop 20 to a portion of the stapler. As another example, one or more springs may connect the rear portion of the sheet stop 20 directly the stapler itself, independent of a need for a separate anchor. Of course, it may be recognized that alternative ways of resiliently biasing the sheet stop 20 are available without departing from the invention. The foregoing has been offered for the sake of illustrating one such way and enabling the device.

Moreover, although the means for incrementally adjusting the sheet stop is depicted as a mechanically operable gear assembly, one skilled in the art will recognize that the same may be coupled to a motor electrically configured to rotate the drive gear each time the stapler is activated. More particularly, in some embodiments, one or more switches may be provided to trigger a circuit board defining operation of the motor. When a switch is triggered, the motor may spin, causing the drive gear to rotate and press the sheet stop forward by a predetermined amount. When a final switch is triggered, the motor may cause the sheet stop to return to a first position. Of course, it will be recognized that optional motorized or mechanical adjustment is possible for or other embodiments of the means for setting the depth at which fasteners can be delivered into a set of sheet material as well. For example, where the means for setting the depth is a plunger, a motor may be provided to automatically incrementally adjust the plunger, rather than the sheet stop, to deliver successive fasteners into sets of sheet material at different depths relative to an edge of such sheets.

Figure 4:
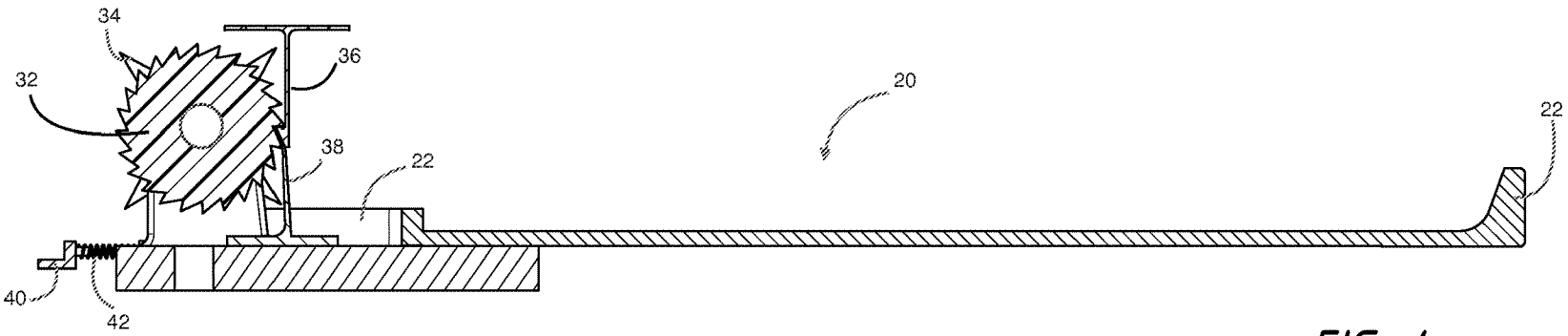
FIG. 4 is a cross-sectional view of the assembly illustrated in FIG. 1.

With reference to FIG. 4, a cross sectional view clearly demonstrates an embodiment of the gear pin 36 shown hooked into a downward facing tooth in the drive gear 32. More particularly, it may be seen that the gear pin 36 may have an upper flat portion and lower hooked portion extending downward therefrom to mesh with a teeth comprising the drive gear 32 which the gear lock 38 extends upward from the foot 12 to prevent the gear from rotating while the stapler remains unactivated. As may be seen with reference to FIG. 5 the flat upper portion of the gear pin 36 may be pressed downward when the stapler is activated to dispense fasteners. In one embodiment, a shaft 37 may be disposed on a portion of the stapler to aid pressing the gear pin 36, however other configurations and means for dislodging the gear pin 36 from its meshed position are also contemplated. In any event, because the drive gear 32 and repositioning gears 34 may be mounted along a single axis, it is contemplated that rotating the drive gear 32 in this manner by an increment defined by the space between each tooth in the drive gear 32 may cause any repositioning gears 34 to rotate in the same direction and by the same amount.

In an embodiment, a bottom most tooth in any repositioning gears 34 may be in physical contact with the rear portion 24 of the sheet stop 20. As such, such repositioning gears 34 may press the sheet stop 20, by way of the rear portion 24 in the opposite direction of any resilient bias created by the anchor 40 and springs 42. As such, when the repositioning gears 34 are caused to rotate by an increment defined by the space between each tooth in the drive gear 32, the sheet stop 20 may be pressed forward, toward the front stopper portion 22, by the same amount.

An embodiment of the repositioning assembly is shown disposed within an exemplary manual stapler in FIGS. 5-8 in order to more clearly illustrate the effect of the rotation described above.

In one embodiment, a repositioning assembly may be disposed within any stapler known in the art for use in the home, office, schools, and the like. Such staplers may have, for example, a body having a cartridge 52 for dispensing fasteners such as staples 54, a cap for covering the cartridge 52, and a means for delivering the staples through the cartridge such as a plunger 58 disposed on an underside of the cap. A base 60 may be provided on which an anvil may be disposed directly beneath the plunger 58 of the cartridge 52 for bending staple legs around a backside of any fastened sheets 62. The base 60 may moreover have a front end and a rear end, the base 60 further having an anvil disposed on the front end of the base 60, wherein the cartridge 52 is pivotally connected to the base 60 and is further resiliently biased toward a resting upper position.

Although the repositioning assembly is here shown disposed along the base 60 of a stapler, it is also contemplated that the repositioning assembly may be disposed along an underside of the cap to automatically incrementally adjust the plunger rather than the paper stop. In such an embodiment, the plunger may be adjusted to press fasteners into sets of sheet material at different depths while any sheet stop may remain stationary to define an unmoving barrier for each successive set of sheet material. Of course, other orientations suitable for disposing the repositioning assembly in various types of staplers, such as electric, spring-loaded, or even those for use in copy machines, are contemplated. The orientation illustrated is thus offered by way of example only and not of limitation.

Figure 5:
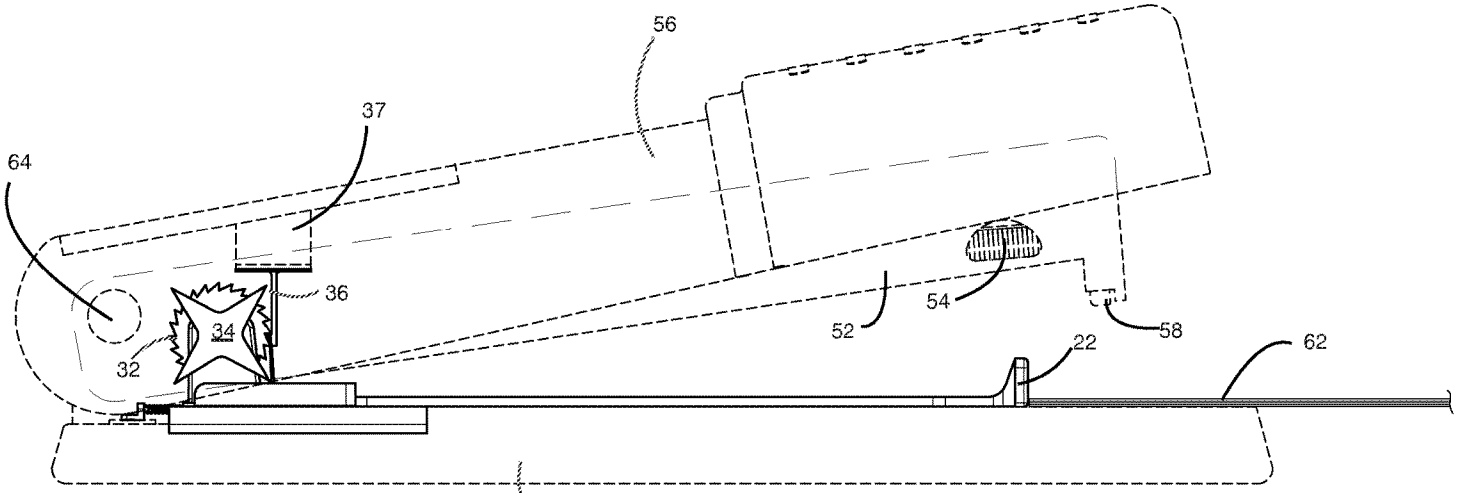
FIGS. 5-8 illustrate an embodiment of the assembly illustrated in FIG. 1 disposed within a stapler in use.
Figure 6:
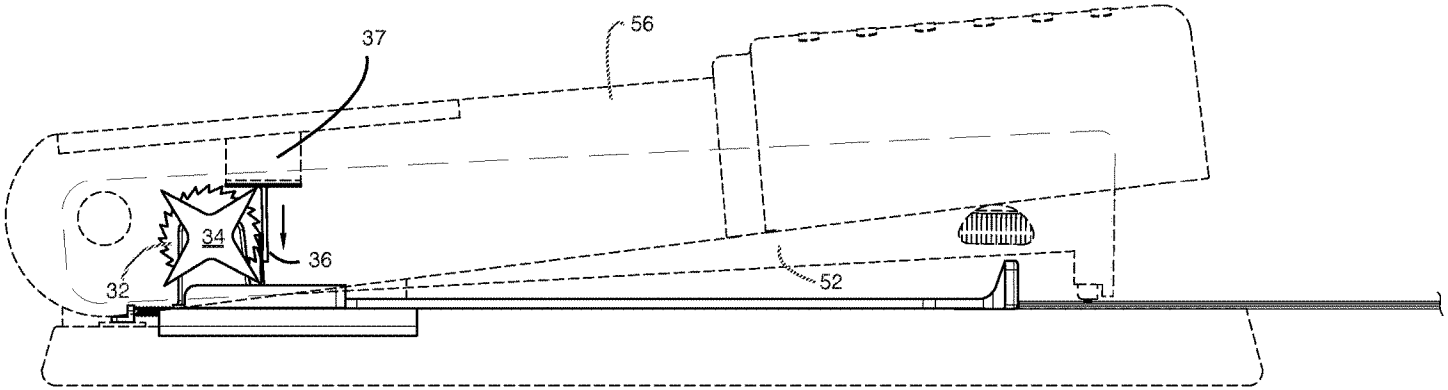
Figure 7:
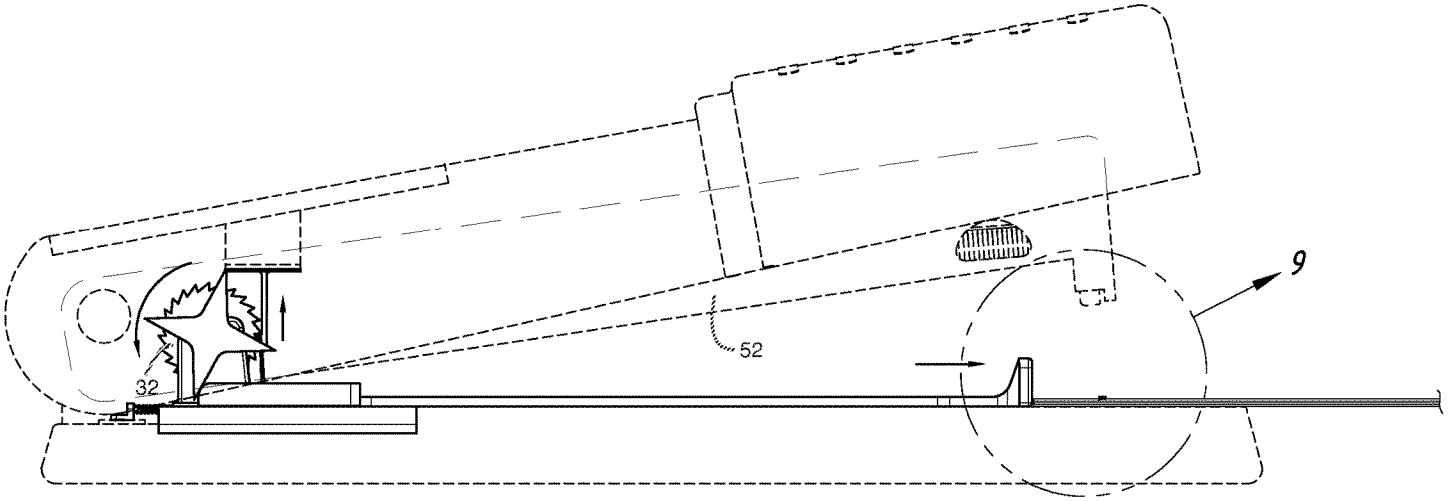
Figure 8:
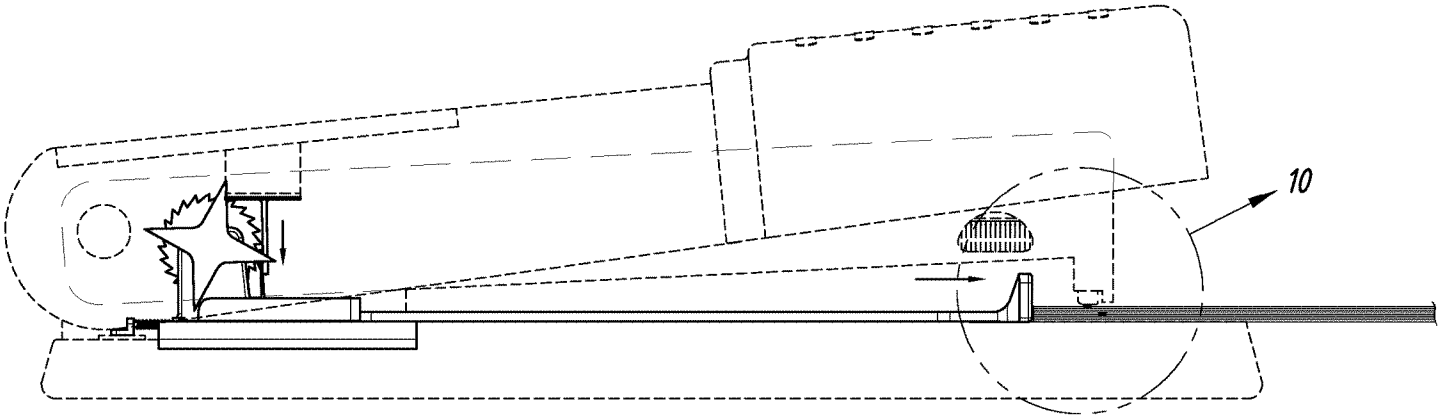

As illustrated in FIG. 5, an embodiment may further comprise a gear lock 38 positioned so as to prevent counter rotation of the drive gear 32. In such an embodiment, the gear pin 36 may prevent undesirable interference with rotation of the gears while the stapler is pivotally activated to deliver fasteners into any sheets.

Of course, other staplers are contemplated. For example, the repositioning assembly may be disposed within a manual, electrically driven, or even copy machine stapler. In other embodiments, any such staplers already available in the market may be retrofit with a repositioning assembly to become automatically adjusting staplers.

Thus, configured according to any of the aforementioned embodiments, sheets 62 of material may be placed between the cartridge 52 and anvil of the stapler until an edge of the stack rests flush against the front stopper portion 22 of the sheet stop. Then, the stapler may be activated to deliver a fastener, such as a staple 58, through the sheets 62 by pressing the cartridge toward the anvil. In some embodiments, activation may be manual. For example, a manual office stapler may be activated when a user presses down on the cap 56. In other embodiments, activation may be automatic. Activation may be automatic, for example, in power driven stapler, such as typical electric desktop staplers or even those staplers disposed within copy machines to staple collated photocopies.

Upon activating the stapler to press the cartridge toward the anvil, rotation of the drive gear may begin. For example, it may be seen in FIG. 7 that a tooth in the drive gear 32 is pulled upward by the gear pin 36 when the resilient bias of the stapler cartridge returns the cartridge 52 to a resting upward position. This causes any repositioning gears 34 to push the rear portion 24 and consequently front stopper portion 22 of the sheet stop 20 forward. As such, an automatic rotation upon activation of the stapler will effect repositioning of the sheet stop 20, which in turn will automatically offset any staples placed in successive sets of sheets from one another as the depth defined by the front portion 22 of the sheet stop 20 changes. Thus, as may be seen in FIG. 8, a next set of sheets may receive a fastener at a different depth than the prior set. This is because the sheet stop 20 has been automatically adjusted.

Figure 10:
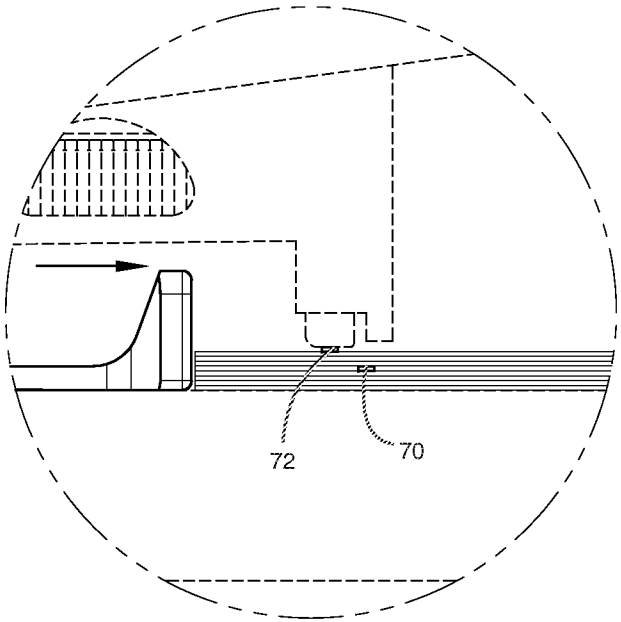
FIGS. 9 and 10 illustrate close up views of staple positioning shown in FIGS. 7 and 8.
Figure 9:
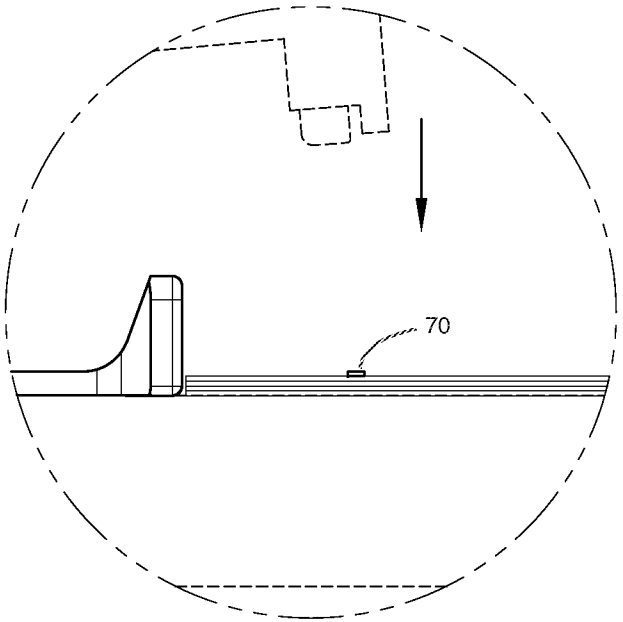

Zoomed in views of successive fastener positions taken at circles 9 and 10, respectively, are shown in FIGS. 9 and 10. As the stapler is released toward its resting, upward position, the drive gear may turn and move the sheet stop 20 component of the repositioning assembly forward by a predetermined increment, which may be set, for example, by the distance between each tooth in the drive gear. Thus in FIGS. 9 and 10, successive staples 70 and 72 are shown spaced apart from each other.

More particularly, in some embodiments, the gear drive, and thus sheet stop 20, may be configured to offset successive fasteners at ⅛ inch increments from one another. If the start position causes the barrier of the sheet stop 20 to set a depth of ½ inch (or ⅝ inch) from an edge of the sheets provided, then the following would happen if the stapler was used to fasten six sets of sheets: A fastener would be delivered into successive sets of sheets at ⅝, ⅝, ⅝, ⅞, 8/8 inches, and then repeating such successively spaced fastening at ⅝ inches from an edge of the sheets. Of course, one skilled in the art will recognize that the particular number of positions achieved, as well as the size of each increment, may be selected or adjusted. Moreover, it will be recognized by one skilled in the art that such successive fastening may be achieved with other means for setting the depth that fasteners can be delivered into the sets of sheet material. For instance, although a sheet stop is particularly discussed, a plunger may be incrementally adjusted to deliver fasteners into successive sets at depths of ⅝, ⅝, ⅝, ⅞, 8/8 inches from an edge of the sheets. Thus, the foregoing is simply provided by way of example and of illustration and is not meant to limit the invention. As such, it is contemplated that this may avoid causing any fasteners provided on stacked sets of sheets to abut, undesirably creating space-inefficient bulging on and around the area occupied by abutting fasteners.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

Moreover, embodiments and limitations disclosed herein are not dedicated to the public under the doctrine of dedication if the embodiments and/or limitations: (1) are not expressly claimed in the claims; and (2) are or potentially are equivalents of express elements and/or limitations in the claims under the doctrine of equivalents.

CONCLUSIONS, RAMIFICATIONS, AND SCOPE

While certain embodiments of the invention have been illustrated and described, various modifications are contemplated and can be made without departing from the spirit and scope of the invention. For example, the type of fastener delivered by a stapler according to the claims may vary depending on a user's needs. Accordingly, it is intended that the invention not be limited, except as by the appended claim(s).

The teachings disclosed herein may be applied to other systems and apparatuses, and may not necessarily be limited to any described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions and concepts of the various references described above to provide yet further embodiments of the invention.

Particular terminology used when describing certain features or aspects of the invention should not be taken to imply that the terminology is being refined herein to be restricted to any specific characteristics, features, or aspects of the automatically repositioning stapler with which that terminology is associated. In general, the terms used in the following claims should not be constructed to limit the automatically repositioning stapler to the specific embodiments disclosed in the specification unless the above description section explicitly defines such terms. Accordingly, the actual scope encompasses not only the disclosed embodiments, but also all equivalent ways of practicing or implementing the disclosed apparatus. The above description of embodiments of the automatically repositioning stapler is not intended to be exhaustive or limited to the precise form disclosed above or to a particular field of usage.

While specific embodiments of, and examples for the apparatus are described above for illustrative purposes, various equivalent modifications are possible for which those skilled in the relevant art will recognize.

While certain aspects of the apparatus disclosed are presented below in particular claim forms, various aspects of the apparatus are contemplated in any number of claim forms. Thus, the inventor reserves the right to add additional claims after filing the application to pursue such additional claim forms for other aspects of the automatically repositioning stapler.

What is claimed is:

1. A repositioning assembly for a stapler, comprising:

means for setting the depth at which a fastener can be delivered into a set of sheet material relative to an edge of the sheet material;

means for incrementally adjusting the means for setting the depth, wherein the means for incrementally adjusting the means for setting the depth comprises an axially rotatable drive gear operative to rotate by a predetermined amount each time the stapler is activated;

wherein the repositioning assembly is disposed within a stapler;

wherein each incremental adjustment of the means for setting the depth automatically causes successively delivered fasteners to be offset from one another when sets of fastened sheet material are stacked, wherein the front portion of the means for setting the depth defines a depth at which the fasteners are offset;

at least one repositioning gear axially and rotatably coupled to the drive gear;

a gear pin having a flat portion and a hook extending therefrom to grab a tooth of the drive gear;

a gear lock to prevent the drive gear from rotating independent of activation of the stapler;

wherein the at least one repositioning gear is positioned so that a bottom most tooth of the at least one repositioning gear presses against the resiliently biased rear end of the sheet stop; and wherein, when the stapler is activated to deliver a fastener into sheet material, the gear pin is pressed to grab a successive tooth in the drive gear so that as the stapler returns to its resting position, the gear pin pulls the drive gear, causing the drive gear and the at least one repositioning gear to rotate, the at least one repositioning gear pushing the means for setting the depth forward by an incremental amount defined by the space between each tooth in the drive gear.

2. The repositioning assembly of claim 1, wherein activation of the stapler may occur manually or electrically.

3. The repositioning assembly of claim 1, wherein the means for setting the depth comprises:

a sheet stop having a front stopper portion, a rear portion slideably mateable with a foot for supporting the assembly along a base of the stapler, and a middle portion for rigidly spacing the front and rear portions.

4. The repositioning assembly of claim 3, wherein the sheet stop is resiliently biased in the direction of the rear portion so that the sheet stop automatically retracts to a first position after a predetermined number of incremental adjustments have been performed.

5. The repositioning assembly of claim 1, wherein the means for setting the depth comprises:

a plunger for pushing fasteners into the set of sheet material, the plunger having a rear plunger portion, wherein the rear plunger portion is slideably mateable with a foot for supporting the assembly, wherein the plunger is resiliently biased in the direction of the rear plunger portion so that the plunger retracts to a first position when a predetermined number of incremental adjustments have been performed.

6. The repositioning assembly of claim 1, wherein the assembly is disposed within a power driven stapler.

7. The repositioning assembly of claim 6, wherein the power driven stapler is further disposed within and communicative with a machine that automatically fastens printed and collated documents.

8. The repositioning assembly of claim 1, wherein the assembly is configured to optionally retrofit an existing stapler.

9. A repositioning assembly for a stapler, comprising:

means for setting the depth at which a fastener can be delivered into a set of sheet material relative to an edge of the sheet material, wherein the means for setting the depth comprises a sheet stop having a front stopper portion, a rear portion slideably mateable with a foot for supporting the assembly along a base of the stapler, and a middle portion for rigidly spacing the front and rear portions; and means for incrementally adjusting the means for setting the depth comprising an axially rotatable drive gear;

wherein the repositioning assembly is disposed within a stapler; and wherein each incremental adjustment of the means for setting the depth automatically causes successively delivered fasteners to be offset from one another when sets of fastened sheet material are stacked.

10. The repositioning assembly of claim 9, wherein the sheet stop is resiliently biased in the direction of the rear portion so that the sheet stop automatically retracts to a first position after a predetermined number of incremental adjustments have been performed.

11. The A repositioning assembly for a stapler, comprising:

means for setting the depth at which a fastener can be delivered into a set of sheet material relative to an edge of the sheet material comprising a plunger for pushing fasteners into the set of sheet material, the plunger having a rear plunger portion, wherein the rear plunger portion is slideably mateable with a foot for supporting the assembly; and means for incrementally adjusting the means for setting the depth comprising an axially rotatable drive gear operative to rotate by a predetermined amount each time the stapler is activated;

wherein the repositioning assembly is disposed within a stapler;

wherein each incremental adjustment of the means for setting the depth automatically causes successively delivered fasteners to be offset from one another when sets of fastened sheet material are stacked; and wherein activation of the stapler may occur manually or electrically.

12. The repositioning assembly of claim 11, wherein the plunger is resiliently biased in the direction of the rear plunger portion so that the plunger retracts to a first position when a predetermined number of incremental adjustments have been performed.

13. A repositioning assembly for a stapler, comprising:

means for setting the depth at which a fastener can be delivered into a set of sheet material relative to an edge of the sheet material; and means for incrementally adjusting the means for setting the depth comprising an axially rotatable drive gear;

wherein the repositioning assembly is disposed within a manual stapler, and wherein each incremental adjustment of the means for setting the depth automatically causes successively delivered fasteners to be offset from one another when sets of fastened sheet material are stacked.

* * * * *